US006629438B1

(12) United States Patent
Stingel et al.

(10) Patent No.: US 6,629,438 B1
(45) Date of Patent: Oct. 7, 2003

(54) NEEDLE SET

(75) Inventors: Uwe Stingel, Messstetten (DE); Bob Hagens, Denver, NC (US); Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/304,065

(22) Filed: Nov. 26, 2002

(51) Int. Cl.[7] ..... D04B 35/02
(52) U.S. Cl. ..... 66/123
(58) Field of Search ..... 66/116, 119, 120, 66/121, 123, 114, 115

(56) References Cited

U.S. PATENT DOCUMENTS 3,748,875 A * 7/1973 Slof et al. ..... 66/123
3,967,468 A * 7/1976 Christopoulos ..... 66/20
4,036,036 A * 7/1977 Ashmead et al. ..... 66/123
4,625,527 A * 12/1986 Fukuhara ..... 66/123
4,956,981 A * 9/1990 Iida ..... 66/20

FOREIGN PATENT DOCUMENTS

JP 62-191888 * 12/1987 ..... 66/123

* cited by examiner

*Primary Examiner*—Danny Worrell
(74) *Attorney, Agent, or Firm*—Venable LLP; Norman N. Kunitz

(57) ABSTRACT

The needles (18, 19) of a needle set (17), which substantially agree in their geometry, have butts (28, 29) of different lengths, which have a predetermined breaking point (57, 58). The predetermined breaking points are differently embodied, so that the breaking torques of the butts (28, 29) of the needles (18, 19), which are a part of the set (17), are different. By means of this it is possible, on the one hand, to assuredly prevent damage to the knitting machine, but on the other hand to assure the dependable operation of the needles.

11 Claims, 3 Drawing Sheets

Figure 1:
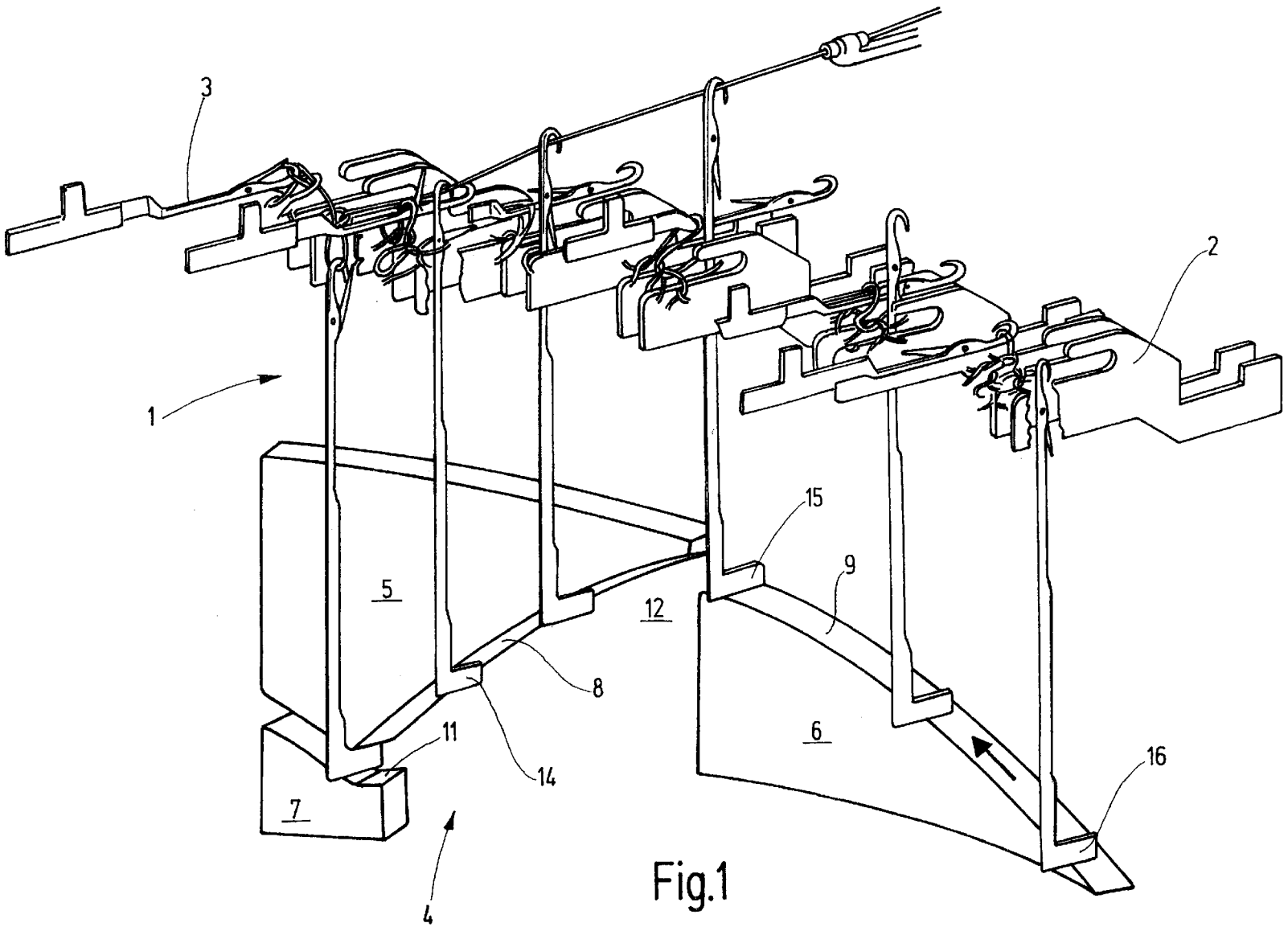

17
18
19
21
22
23
24
25
26
27
28
29
31
32
33
34
35
36
37
41
42
43
44
45
46
51
52
53
54
55
56
57
58
59
L1
L2
L3
A
R
α
V
VII
IX

NEEDLE SET

The invention relates to a needle set, in particular for knitting machines.

Knitting machine needles have an elongated shank, usually formed from a flat material, from which one or several butts extend laterally away. The butts are used for displacing the needles linearly in a needle groove. To this end, they are connected with a so-called cam. The butts travel through a cam groove by means of a relative movement of the cam in respect to the needles, or the needle bed receiving them, and in this way cause the linear displacement of the needle. As a rule, this functions absolutely dependably. However, at times collisions between the needle butts and parts of the cam can occur because of erroneous control of components of the needle cam, as well as other accidental occurrences. These must not be allowed to result in damage to machine parts of the knitting machine, in particular damage to the cam or the needle bed. The needle bed is constituted by a multipart solid body, into which closely arranged grooves in accordance with the mostly relatively narrow distribution have been cut, which constitute needle grooves. Partitions are provided between the individual grooves, which laterally guide the needles. It is necessary, even in case of a malfunction, to prevent damage to such partitions or other damage to the needle bed.

A needle for knitting machines is known from JP 620191888, whose butt has predetermined breaking points. These are constituted by notches formed on the long narrow sides of the butt, which cause a specific weakening of the butt. The latter can break off in case of a collision of the butt with cam elements, so that damage to the needle bed can be prevented to a large extent.

Moreover, knitting machines exist which require needles of different butt lengths. For example, such needles are required if needles of the same needle bed are to be moved over different lengths in the course of the knitting process. In this case it is intended that long butts come into engagement with other cam elements than short butts.

Based on the foregoing, it is the object of the invention to design the needles in such a way that the damage of machine elements of the knitting machine because of collisions between cam or selecting elements with needle butts are prevented even if the needle butts are of different lengths.

This object is attained by means of the needle set in accordance with claim 1.

The needle set, or the needle family, in accordance with the invention has at least two, but preferably three or more needles, whose loop-forming elements are identical, wherein the butts of these needles are of different lengths. The butts are provided with predetermined breaking points which establish different breaking resistances. If the breaking resistance is great, a relatively large breaking torque is created during the breaking process, which attempts to turn the needle around its longitudinal axis. This breaking torque must be absorbed by the needle bed. The different needles of the needle family, or of the needle set, now have different breaking torques. These are preferably matched in such a way that the largest occurring breaking torques cannot damage the needle groove, or the needle bed. On the other hand, the breaking torques are preferably set in such a way, in particular in view of the length of the butts, that forces of approximately the same size are required for developing the different breaking torques at each of the butt ends or butt tips. This measure in turn prevents damage to cam elements. Finally, the predetermined breaking points are dimensioned in respect to the breaking torque, which occurs because of a strain on the butts in the axial direction of the needle, i.e. when the driving force is transmitted, in such a way that all needles of the needle set can permanently tolerate even the largest occurring driving force.

The predetermined breaking points are embodied in such a way that a larger breaking torque is required for needles with longer butts than for needles with shorter butts. This can be achieved in that the predetermined breaking points between the needle types differ in regard to their size and/or their shape and/or their position. Larger breaking torques of the longer butts primarily relate to a strain on the butt which extends approximately vertically on its flat side. Regarding the driving torque, the breaking resistance of the butts is preferably substantially the same. This can be achieved in that the predetermined breaking points are constituted by depressions which are formed on the flat side of each butt approximately parallel in respect to the longitudinal direction of the needle. These depressions hardly weaken the butt in respect to the transmission of the driving force (along the needle). But they permit an easier breaking in case of a strain on the butt transversely in respect to the needle. By means of this a particularly good protection of the machine bed and of the cam is achieved, without limiting the operating ability and service life of the needle.

Depressions, which are formed parallel in respect to each other and to the longitudinal direction of the needle, and are located outside of the needle bed, are preferably embodied on both flat sides as predetermined breaking points. They are therefore approximately arranged in the area of the transition from the needle shank to the butt, or even slightly distant from the needle shank. They are preferably located on a common plane extending vertically in respect to the flat side of the butt. In addition it is advantageous if the predetermined breaking point is arranged in an area located between the cam and the needle bed. In this way it is possible to achieve that no damage to the machine occurs as a result of a needle break.

The predetermined breaking points are constituted by grooves, for example, which are rounded. Preferably the radii of all predetermined breaking points of the needles of a needle family are identical wherein, however, the depths of the respective depressions are different. The breaking resistance can be regulated by means of the amount of depth. In this case the length of the depression essentially corresponds to the width of the butt, i.e. preferably the depression extends over the entire flat side of the butt.

It has been shown that a needle bed can easily absorb the relatively large breaking torques which the needle set of the invention assigns to the needles with long butts, so that even long butts are maintained dependably and solidly on the needle shank. On the other hand, it has been shown that the low breaking torques of short-butted needles are completely sufficient for transmitting the desired driving forces and for achieving the required service life.

Further details of advantageous embodiments of the invention ensue from the drawings, the description or the dependent claims.

Figure 2:
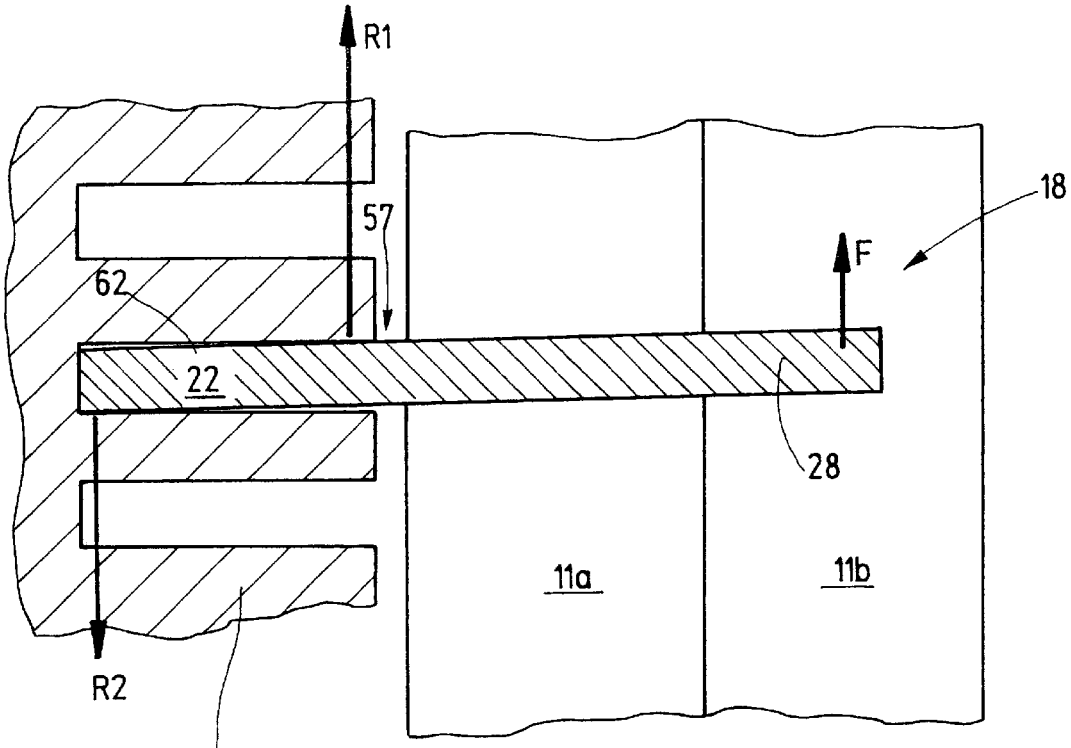
Figure 3:
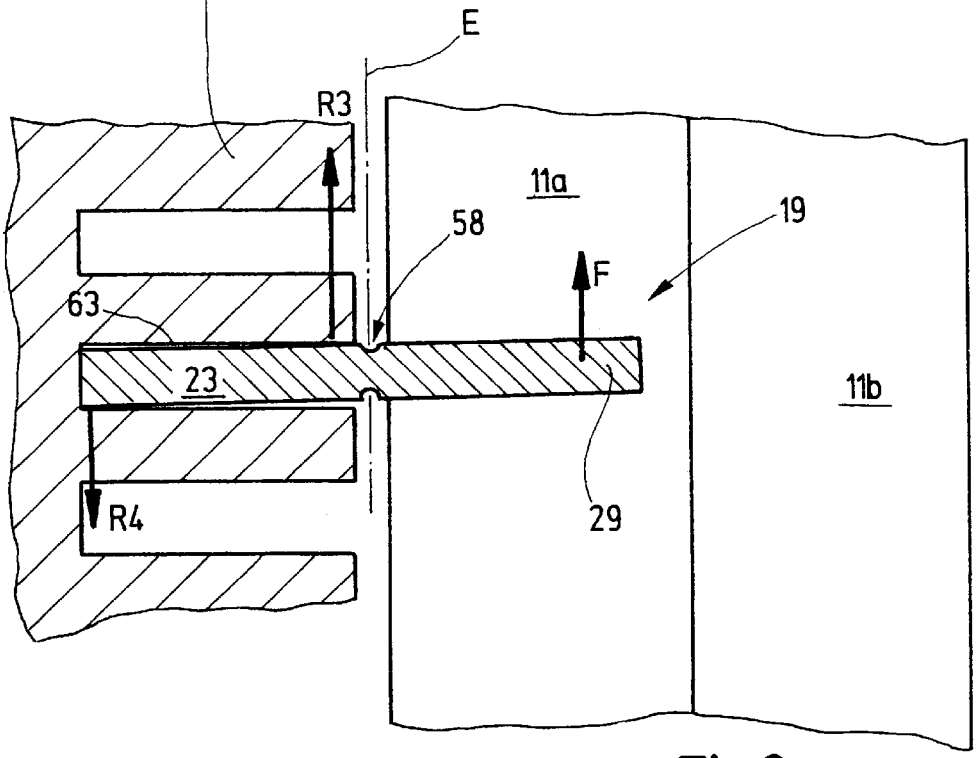
Figures 4, 5, 6, 7, 8, 9:
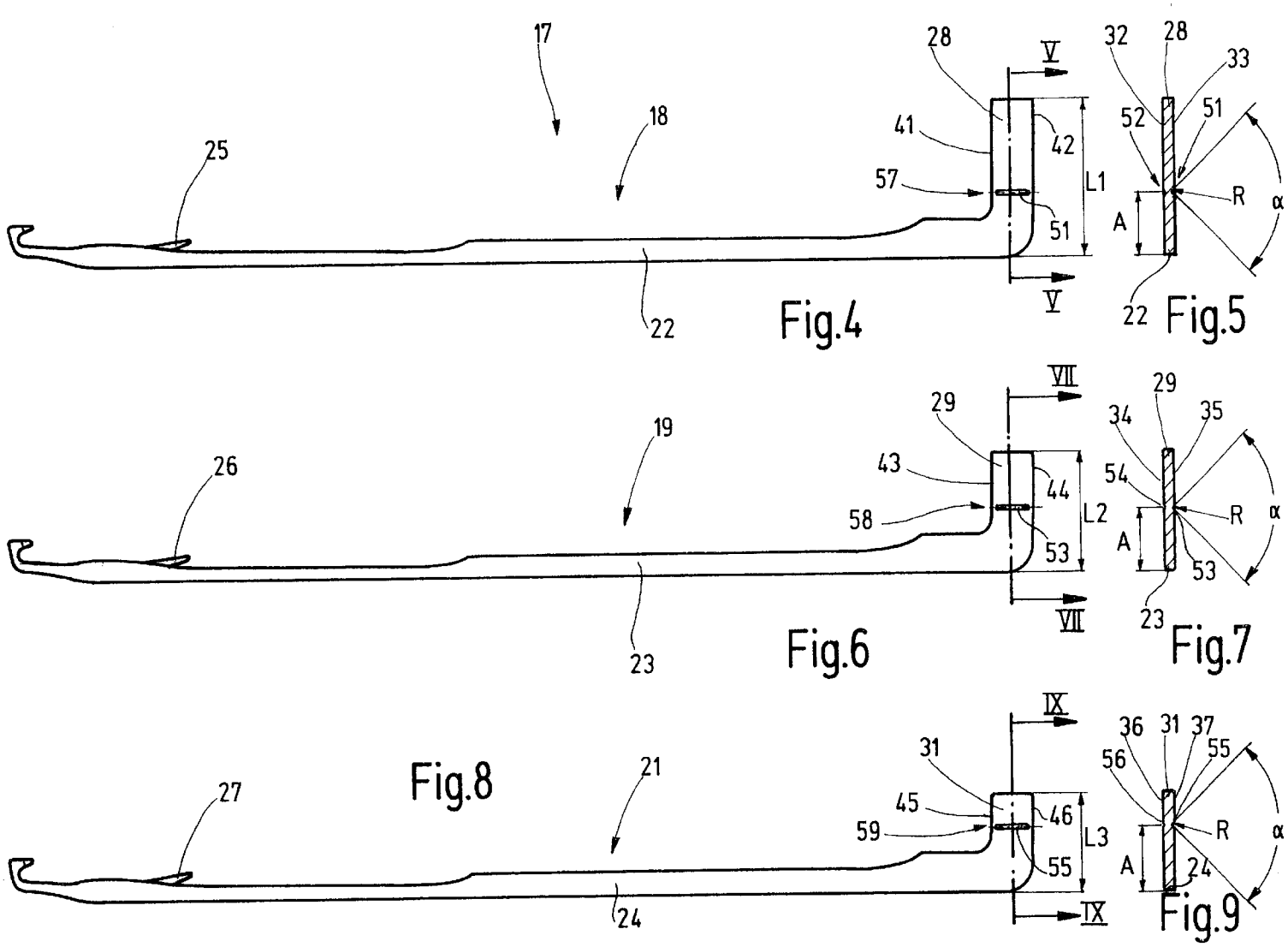

An exemplary embodiment of the invention is represented in the drawings. Shown are in:

FIG. 1, a schematic perspective representation of knitting systems with needles and needle cam of a knitting machine, FIG. 2, a schematic sectional representation of the needle bed, cam groove and needle with a long butt, FIG. 3, a schematic sectional representation of the needle bed, cam groove and needle with a short butt, FIG. 4, a lateral view of a needle with a long butt, which is part of a needle set, FIG. 5, a sectional view along the line V—V of the needle in FIG. 4, FIG. 6, a lateral view of a needle of the needle set with a medium butt, FIG. 7, a sectional view along the line VII—VII of the needle in FIG. 6, FIG. 8, a lateral view of a needle with a short butt, which is part of a needle set, FIG. 9, a sectional view along the line IX—IX of the needle in FIG. 8.

A group of needles 1 is illustrated in FIG. 1 which, together with sinkers 2 and further needles 3 arranged transversely in respect to the first mentioned needles 1, constitute a knitting system of a knitting machine. The needles 1 are driven by a cam 4, part of which are cam elements 5, 6, 7. The latter define a cam groove 12 with their guide faces 8, 9, 11. The groove is used for driving the needles 1, whose butts 14, 15, 16 project into the cam groove 12.

The needles 1 constitute a needle family 17, or needle set, consisting of three needles, which are illustrated in FIGS. 4, 6 and 8 by means of needles 18, 19, 21. For example, the needles 1 in FIG. 1 include the needles 18, 19, 21 of the needle set 7. Each of the needles 18, 19, 21 has a shank 22, 23, 24, which has a hook at the end. The needles 18, 19, 21 are embodied as latch needles, for example, so that a latch 25, 26, 27 is pivotably seated in the vicinity of each hook for opening and closing the hook in a controlled manner.

A butt 28, 29, 31 is formed on the shank 22, 23, 24 of each needle 18, 19, 21 which, the same as the respective shank 22, 23, 24, consists of a flat material (steel) and makes a seamless transition into the latter. Here, as illustrated in FIGS. 5, 6, 9, each butt 28, 29, 31 has two flat sides 32, 33, 34, 35, 36, 37, which are parallel in respect to each other and make a transition into the flat sides of the needle shanks 22, 23, 24. In a lateral view the butts 28, 29, 31 are embodied to be approximately square. Their straight continuous narrow sides 41, 42, 43, 44, 45, 46 make transitions into the shank, as shown in FIGS. 4, 6 and 8. Neither notches nor depressions have been cut into these narrow sides 41, 42, 43, 44, 45, 46. However, the flat sides 32, 33, 34, 35, 36, 37 are provided with depressions 51, 52, 53, 54, 55, 56, which define predetermined breaking points 57, 58, 59. In this case the depressions extend over the entire length of the respective flat sides 32, 33, 34, 35, 36, 37 and terminate at the respective narrow sides 41, 42, 43, 44, 45, 46. They are straight and extend approximately parallel in respect to the respective shank 22, 23, 24. They are moreover each arranged at corresponding locations, i.e. their distance A from the needle back is identical in each case (FIGS. 5, 7, 8).

Preferably the depressions 51, 52, 53, 54, 55, 56 are constituted by a rounded groove, whose radius of curvature R has been set identically for all three needles 18, 19, 21. Furthermore, the flanks of the groove of all three needles 18, 19, 21 enclose the same angle a with one another. The depths of the depressions 51, 52 agree with each other. In the same way the depths of the depressions 53, 54, as well as the depths of the depressions 55, 56 each correspond to each other. However, the depth of the depressions 51, 52 is less than that of the depressions 53, 54. The latter are in turn less deep than the depths of the depressions 55, 56. By means of this the predetermined breaking points 57, 58, 59 define different breaking torques.

Except for the length L1, L2, L3, the needles 18, 19, 21 are identical. The length L1 of the butt 28 is the greatest. The depressions 51, 52 have the least depth. The breaking resistance of the predetermined breaking point 57 is the greatest in comparison to the needles 19, 21. The length L2 of the butt 29 is less than the length L1 of the butt 28.

The length L3 of the butt 31 in the needle set 17 is the least. The breaking resistance of the predetermined breaking point 59 is also the least. In this case, the breaking resistances relate to the breaking torque required for breaking off the respective butts 28, 29, 31 by means of a strain extending vertically in respect to their flat sides 32, 33, 34, 35, 36, 37, while the shank 22, 23, 24 is held fast. However, in respect to a driving force which charges the respective butt 28, 29, 31 in the longitudinal shank direction and which generates a driving torque, whose vector extends vertically in respect to the flat sides 32, 33, 34, 35, 36, 37, the breaking resistances of the butts 28, 29, 31 are substantially equal. The reason for this is the linear orientation of the depressions 51, 52, 53, 54, 55, 56.

The needles 18, 19, 21 of the needle set 17 protect the knitting machine against damage in case of erroneous control in that the butts 28, 29, 31 break off in a controlled manner. To illustrate this, reference is made to FIGS. 2 and 3 with the needles 18, 19.

A needle bed 61 receives the needles 18, 19 of the needle set 17. The shanks 22, 23 of the needles 18, 19 are seated in needle grooves 62, 63, which are arranged with regular spacing corresponding to the needle distribution and are identically embodied. Shanks 22, 23 are guided on the flanks of the needle grooves. The narrow sides of the butts 28, 29 extend onto corresponding guide faces 11*a*, 11*b* of the cam groove while touching them with their narrow sides. The guide faces 11*a*, 11*b* can be differently embodied, so that the needle 18 performs a different movement from that of the needle 19. In the embodiment of the needle, needle groove and cam track represented here, the predetermined breaking points 57, 58 are located on a plane E between the cam and the needle bed 61. If now a collision between the butt 28 and an element which is part of the cam occurs, a force F is introduced, for example at the end of the butt 28. This force generates bearing reaction forces R1, R2 in the needle groove 62. The size of the reaction forces R1, R2 is limited by the breaking torque of the predetermined breaking point 57. This applies in particular to break-causing forces F acting approximately parallel in respect to the guide faces 11*a*, 11*b*. In this case the breaking torque of the predetermined breaking point 57 has been set in such a way that damage to the needle groove 62 is prevented and the butt 28 is severed at the predetermined breaking point 57 substantially smoothly, i.e. splintering breaks are avoided. The needle is separated into two parts, a shank part and a butt part. The danger that parts of the knitting machine are damaged by flying splinters is nearly eliminated.

Driving forces acting approximately vertically in respect to the drawing plane, and therefore parallel in relation to the shank 22, cannot cause a break at the predetermined breaking point 57. This in particular because the depressions which represent the predetermined breaking point 57 extend parallel in respect to the driving forces, but transversely in respect to a breaking force F.

The needle 19 has a substantially lower breaking torque. The bearing reaction forces R3, R4, which have to be absorbed by the flanks of the needle groove 63 when a breaking force F acts on the butt 29, are correspondingly lower. To achieve this, the predetermined breaking point 58 is considerably more pronounced, i.e. the acceptable breaking torque is less than that at the predetermined breaking point 57. It has been found that the butt 29 can transfer the required driving forces to the needle 19 in spite of this, even though the latter requires driving forces at least as large as the needle 18.

The needles 18, 19 of a needle set 17, which substantially agree in their geometry, have butts 28, 29 of different lengths, which have a predetermined breaking point 57, 58. The predetermined breaking points are differently embodied, so that the breaking torques of the butts 28, 29 of the needles 18, 19, which are a part of the set 17, are different. By means of this it is possible, on the one hand, to assuredly prevent damage to the knitting machine, but on the other hand to assure the dependable operation of the needles.

List of Reference Symbols

| | |
|---|---|
| 1 | Needles |
| 2 | Sinkers |
| 3 | Needles |
| 4 | Cam |
| 5, 6, 7 | Cam elements |
| 8, 9, 11, 11a, 11b | Guide faces |
| 12 | Cam groove |
| 14, 15, 16 | Butts |
| 17 | Needle family, needle set |
| 18, 19, 21 | Needles |
| 22, 23, 24 | Shank |
| 25, 26, 27 | Latch |
| 28, 29, 31 | Butt |
| 32, 33, 34, 35, 36, 37 | Flat sides |
| 41, 42, 43, 44, 45, 46 | Narrow sides |
| 51, 52, 53, 54, 55, 56 | Depressions |
| 57, 58 59 | Predetermined breaking points |
| 61 | Needle bed |
| 62, 63 | Needle grooves |
| A | Distance |
| E | Plane |
| F | Break-causing forces |
| L1, L2, L3 | Length |
| R1, R2, R3, R4 | Bearing reaction forces |
| R | Radius of curvature |
| α | Angle |

What is claimed is:

1. A needle set (17), in particular for knitting machines, having at least two needles (18, 19) which are part of a knitting arrangement, each of which has a shank (22, 23), and from which a butt (28, 29) extends laterally away, wherein the needles (18, 19) have different butt heights, and wherein predetermined breaking points (57, 58) are embodied on each of the butts (28, 29) of both needles (18, 19) in such a way that the butts (28, 29) of the two needles (18, 19) differ in respect to their breaking resistance.

2. The needle set in accordance with claim 1, characterized in that the predetermined breaking points (57) assigned to the longer butts (28) define a larger breaking torque than the predetermined breaking points (58) assigned to the shorter butts (29).

3. The needle set in accordance with claim 1, characterized in that the predetermined breaking points (57, 58) between the needles (18, 19) differ in respect to their size.

4. The needle set in accordance with claim 1, characterized in that the predetermined breaking points (57, 58) between the needles (18, 19) differs in respect to their position.

5. The needle set in accordance with claim 1, characterized in that the predetermined breaking points (57, 58) of the needles (18, 19) fix the same breaking forces (F) at the free butt ends.

6. The needle set in accordance with claim 1, characterized in that predetermined breaking points (57, 58) are constituted by line-like depressions (51, 52, 53, 54), which are formed on at least one flat side (32, 33, 34, 35) of each butt (28, 29).

7. The needle set in accordance with claim 1, characterized in that predetermined breaking points (57, 58) are constituted by line-like depressions (51, 52, 53, 54), which are formed on both flat sides (32, 33, 34, 35) of each butt (28, 29).

8. The needle set in accordance with claim 7, characterized in that the depressions (51, 52, 53, 54) of both flat sides (32, 33, 34, 35) extend parallel with each other.

9. The needle set in accordance with claim 6, characterized in that the depressions (51, 52, 53, 54) extend parallel in respect to the longitudinal direction of the needle shank (22, 23).

10. The needle set in accordance with claim 6, characterized in that the depressions ((51, 52, 53, 54) of the needles (18, 19) have identical radii (R).

11. The needle set in accordance with claim 6, characterized in that the depressions ((51, 52, 53, 54) of the needles (18, 19) have different depths.

* * * * *